US006604906B2

(12) United States Patent
Ozeki et al.

(10) Patent No.: US 6,604,906 B2
(45) Date of Patent: Aug. 12, 2003

(54) CENTRIFUGAL MULTIBLADE BLOWER

(75) Inventors: Yukio Ozeki, Tochigi (JP); Masaharu Onda, Tochigi (JP); Toshio Yajima, Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/921,314

(22) Filed: Aug. 3, 2001

(65) Prior Publication Data

US 2002/0025253 A1 Feb. 28, 2002

(30) Foreign Application Priority Data

Aug. 4, 2000 (JP) ..... 2000-237277

(51) Int. Cl.[7] ..... F04D 29/28; F04B 39/06

(52) U.S. Cl. ..... 415/204; 415/206; 416/186 R; 416/189; 417/370

(58) Field of Search ..... 415/204, 206, 415/208.3; 416/186 R, 189; 417/370

(56) References Cited

U.S. PATENT DOCUMENTS 2,316,608 A * 4/1943 McMahan ..... 415/204 X
5,257,904 A 11/1993 Sullivan
5,281,092 A 1/1994 Sullivan
5,743,721 A * 4/1998 Graham et al. ..... 415/206 X
5,813,831 A * 9/1998 Matsunaga et al. ..... 415/204 X
5,839,879 A 11/1998 Kameoka et al.

FOREIGN PATENT DOCUMENTS

| | | | | |
|---|---|---|---|---|
| EP | 0 589 300 A1 | | 3/1994 | |
| EP | 0 846 868 A2 | | 6/1998 | |
| JP | 64-41700 | | 2/1989 | ..... F04D/29/44 |
| JP | 2002021790 A | * | 1/2002 | ..... F04D/29/44 |
| WO | WO 9009524 A1 | * | 8/1990 | ..... F04D/29/20 |

* cited by examiner

*Primary Examiner*—Edward K. Look
*Assistant Examiner*—Richard A. Edgar
(74) *Attorney, Agent, or Firm*—Foley & Lardner

(57) ABSTRACT

A centrifugal multiblade blower includes a first counter-flow prevention means that prevents part of air flowing through a scroll chamber from flowing through a first aperture defined between a multiblade fan and a suction-side case plate of a scroll casing back to a suction port, and a second counter-flow prevention means that prevents part of air flowing through the scroll chamber from flowing through a second aperture defined between the multiblade fan and a motor-side case plate of the scroll casing back to the upstream side of the scroll chamber. A length L1 of the scroll chamber measured in the motor-shaft axial direction is dimensioned to be longer than a length L2 of the multiblade fan measured in the motor-shaft axial direction. Additionally the scroll chamber is gradually enlarged toward a discharge port of the casing.

9 Claims, 7 Drawing Sheets

CENTRIFUGAL MULTIBLADE BLOWER

TECHNICAL FIELD

The present invention relates to a centrifugal multiblade blower suitable to an automotive air conditioning system.

BACKGROUND ART

In automotive air conditioning systems, there is usually employed a centrifugal multiblade blower fan installed upstream of an air duct. One such centrifugal multiblade blower has been disclosed in Japanese Patent Provisional Publication No. 64-41700 (corresponding to Japanese Patent No. 2690731). FIG. 7 is a cross section showing the structure of the centrifugal multiblade blower disclosed in the Japanese Patent No. 2690731. Centrifugal multiblade blower a shown in FIG. 7 is comprised of a multiblade fan b formed with a plurality of blades b1, a blower fan motor c, and a scroll casing d that accommodates therein the multiblade fan b and defines a scroll chamber d1 between the inner periphery of the casing and the outer periphery of the multiblade fan. Multiblade fan b is installed onto a motor shaft c1 of fan motor c. Casing d is formed into a logarithmic spiral shape and comprised of a suction-side case plate d3 formed with a suction port d2 and a fan-motor-side case plate d4 located opposite to the suction-side case plate d3. A motor body c2 of fan motor c is attached to the motor-side case plate d4. The radius R of the logarithmic spiral scroll casing is generally defined by an expression $R=R_0\exp\{n(\theta+\theta_0)\}$, where $R_0$ denotes a radius of the multiblade fan, $\theta$ denotes an angle measured in the direction of rotation of the multiblade fan from a central point of a tongue portion of scroll casing that defines the narrowest portion of the scroll chamber, $\theta_0$ denotes an angle from a point across which a length L1 of the scroll chamber (often called a scroll width) measured in the axial direction of the motor shaft begins to enlarge to the central point of the scroll-casing tongue portion, and n denotes a so-called enlargement angle that represents the magnitude of enlargement of the scroll chamber in the radial direction of the multiblade fan (see FIG. 6). In centrifugal multiblade blower fans used for automotive air conditioning systems, the enlargement angle n is usually set to range from 5 degrees ($8.72\times10^{-2}$ radians) to 8 degrees ($14.0\times10^{-2}$ radians). As is generally known, the volumetric capacity of the scroll chamber tends to increase, as the enlargement angle n increases, and thus the scroll casing is enlarged in the radial direction of the multiblade fan. In other words, the volumetric capacity of the scroll chamber tends to decrease, as the enlargement angle n decreases, and thus the scroll casing is reduced. For the reasons set out above, with the enlargement angle n set to a comparatively smaller angle, it is possible to down-size the scroll casing, but the volumetric capacity of the scroll chamber tends to decrease undesirably. Owing to the decreased volumetric capacity of the scroll chamber, during operation of the centrifugal multiblade blower, there is an increased tendency for the counter-flow rate of air flowing from a suction-side aperture G1 defined between the multiblade fan b and the suction-side case plate d3 toward the suction port d2 to increase. At the same time, there is an increased tendency for the counter-flow rate of air flowing from a motor-side aperture G2 defined between the multiblade fan b and the motor-side case plate d4 toward the upstream side of the scroll chamber d1 to increase. Therefore, in the centrifugal multiblade blower a, although the scroll casing can be down-sized by reducing the enlargement angle n of the scroll chamber, the fan efficiency is reduced. Additionally, due to the reduced enlargement angle n, the pressure in the scroll chamber tends to become unstable. This may increase noises and vibrations during operation of the multiblade fan.

SUMMARY OF THE INVENTION

Accordingly, it is an object of the invention to provide a centrifugal multiblade blower, which avoids the aforementioned disadvantages.

It is another object of the invention to provide a centrifugal multiblade blower, which is capable of down-sizing a scroll casing by reducing a so-called enlargement angle of a scroll chamber, without lowering a fan efficiency and without increasing noises and vibrations.

In order to accomplish the aforementioned and other objects of the present invention, a centrifugal multiblade blower comprises a multiblade fan having a plurality of blades, a fan motor having a motor shaft on which the multiblade fan is mounted, a scroll casing that accommodates therein the multiblade fan and has a discharge port and cooperates with an outer periphery of the multiblade fan to define a spiral scroll chamber, the casing comprising a suction-side case plate having a suction port, and a motor-side case plate which is located opposite to the suction-side case plate in such a manner as to sandwich the multiblade fan between the suction-side case plate and the motor-side case plate, and on which a motor body of the fan motor is mounted, a first counter-flow prevention means for preventing part of air flowing through the scroll chamber from flowing through a first aperture defined between the multiblade fan and the suction-side case plate back to the suction port, and a second counter-flow prevention means for preventing part of air flowing through the scroll chamber from flowing through a second aperture defined between the multiblade fan and the motor-side case plate back to an upstream side of the scroll chamber, wherein a length of the scroll chamber measured in an axial direction of the motor shaft is dimensioned to be longer than a length of the multiblade fan measured in the axial direction of the motor shaft, and the scroll chamber is gradually enlarged toward the discharge port of the casing. It is preferable that the scroll chamber is gradually enlarged in the axial direction of the motor shaft at an axial enlargement angle $\alpha$ representative of a magnitude of enlargement of the scroll chamber in the axial direction of the motor shaft toward the discharge port, and additionally the scroll chamber is gradually enlarged in a radial direction of the multiblade fan at a radial enlargement angle n representative of a magnitude of enlargement of the scroll chamber in the radial direction of the multiblade fan from a tongue portion of the scroll casing toward the discharge port. The radial enlargement angle n is defined by an expression $R=R_0\exp\{n(\theta+\theta_0)\}$, where R denotes a radius of the scroll casing, $R_0$ denotes a radius of the multiblade fan, $\theta$ denotes an angle measured in a direction of rotation of the multiblade fan from a central point of the tongue portion that defines the narrowest portion of the scroll chamber, and $\theta_0$ denotes an angle from a point across which the length of the scroll chamber measured in the axial direction of the motor shaft begins to enlarge to the central point of the tongue portion.

The other objects and features of this invention will become understood from the following description with reference to the accompanying drawings.

DESCRIPTION OF THE PREFERRED EMBODIMENTS

Figure 1:
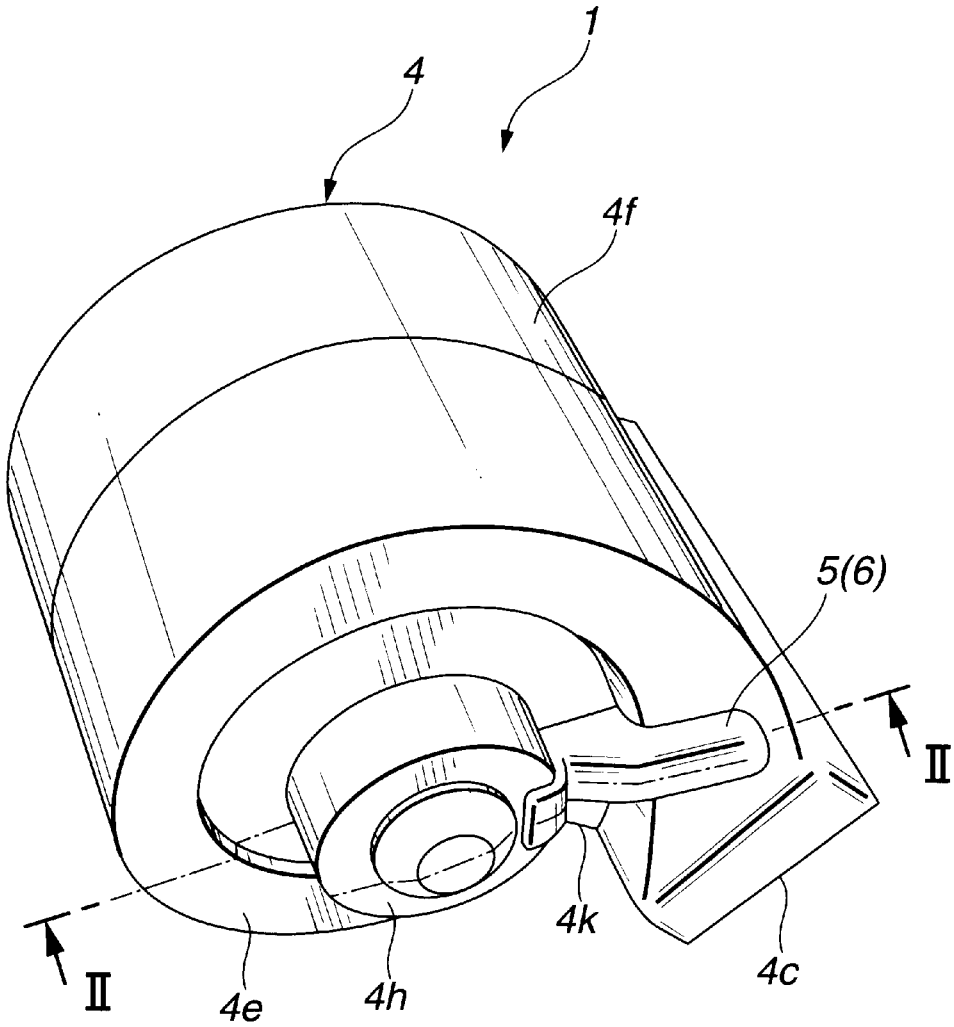
FIG. 1 is a perspective view illustrating a first embodiment of the centrifugal multiblade blower of the invention.
Figure 2:
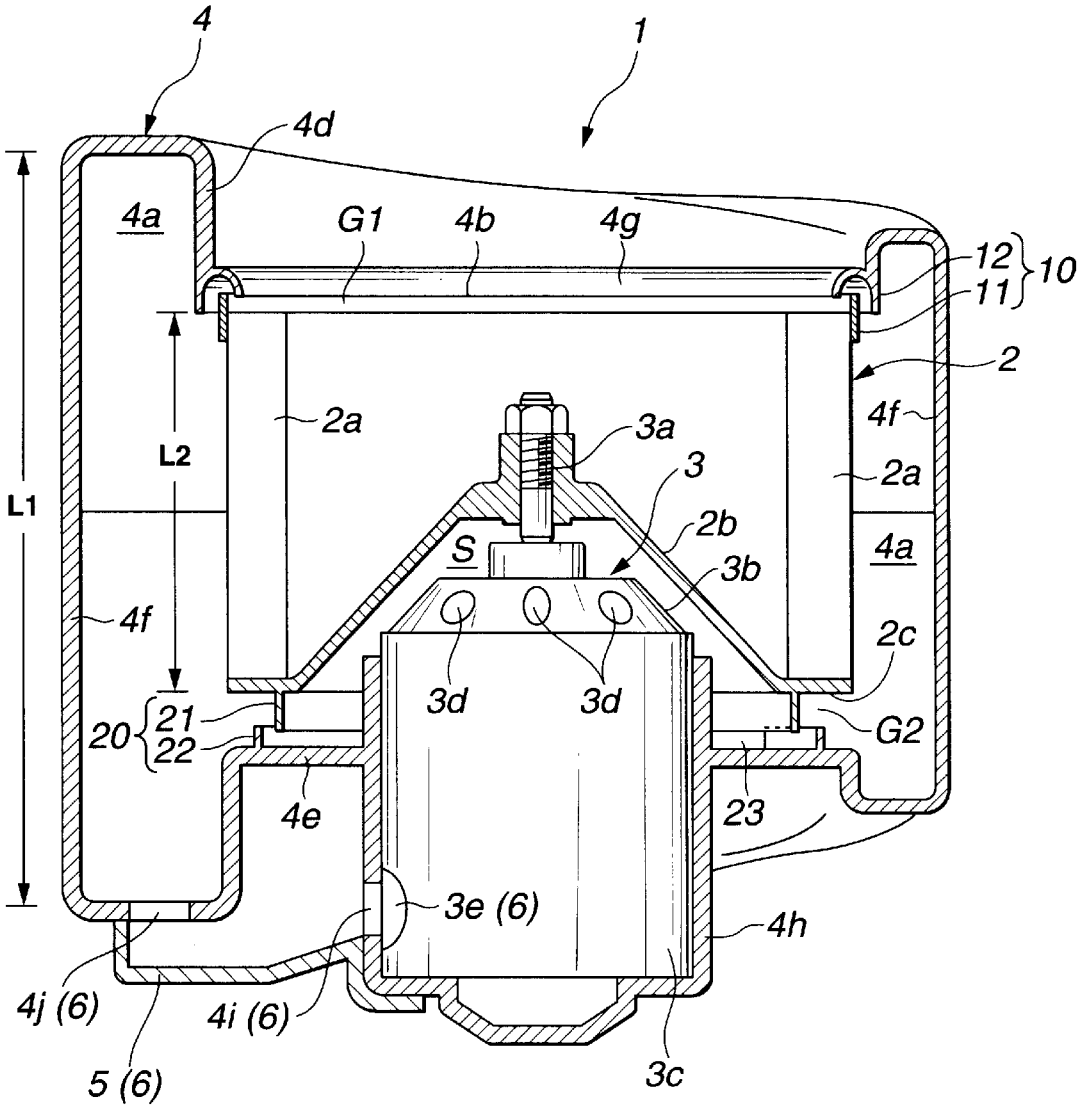
FIG. 2 is a cross-sectional view taken along the line II—II of FIG. 1.
Figure 6:
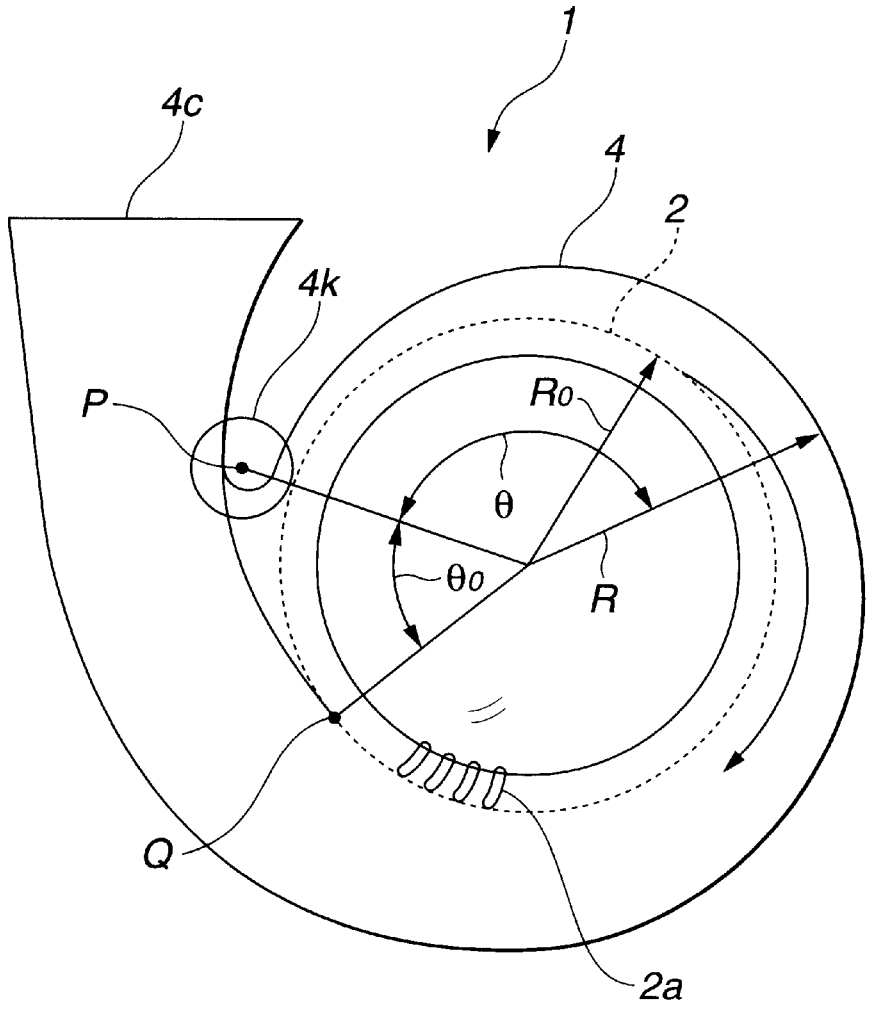
FIG. 6 is a plan view illustrating the centrifugal multiblade blower fan of the first embodiment of FIGS. 1 and 2.

Referring now to the drawings, particularly to FIGS. 1, 2, and 6, the centrifugal multiblade blower 1 of the first embodiment is exemplified in an automotive air conditioning system. Centrifugal multiblade blower 1 is comprised of a multiblade fan 2, a blower fan motor 3, and a logarithmic spiral scroll casing 4. Multiblade fan 2 is formed with a plurality of blades 2*a,* and accommodated in scroll casing 4. As best shown in FIG. 2, multiblade fan 2 is installed onto or fixedly connected to one end of a motor shaft 3*a* of fan motor 3. A motor body 3*b* of fan motor 3 is attached to or mounted in scroll casing 4. Multiblade fan 2 has a conical plate portion 2*b*. Conical plate 2*b* is fixedly connected to the motor shaft end by means of a bolt and a nut, in such a manner as to cover a portion of motor body 3*b* (the upper motor-body portion in FIG. 2). Fan motor 3 is equipped with a motor protective case 3*c* that protects a rotor and a stator incorporated in the motor body. Motor body 3*b* is wholly covered and protected by means of protective case 3*c*. Scroll casing 4 defines a spiral scroll chamber 4*a* between the inner periphery of casing 4 and the outer periphery of multiblade fan 2. Scroll casing 4 is formed with a suction port (air inlet) 4*b* through which air is sucked in or drawn into the multiblade fan, and a discharge port (air outlet) 4*c* through which the air is discharged from scroll chamber 4*a* toward outside of the casing. As clearly shown in FIG. 2, casing 4 is comprised of a suction-side case plate 4*d* formed with the suction port 4*b,* a motor-side case plate 4*e* located opposite to the suction-side case plate 4*d* in such a manner as to sandwich the multiblade fan between the two opposing case plates 4*d* and 4*e,* and an outer peripheral wall plate 4*f* formed continuously with both the two opposing case plates 4*d* and 4*e* and joining them so as to form an outer peripheral wall of scroll chamber 4*a*. Motor body 3*b* is attached to or mounted on the motor-side case plate 4*e*. As viewed from the plan view shown in FIG. 6, the structure of scroll chamber 4*a* of centrifugal multiblade blower 1 of the first embodiment is similar to that of the conventional centrifugal multiblade blower. That is, the radius R of the logarithmic spiral scroll casing 4 is defined by an expression $R=R_0\exp\{n(\theta+\theta_0)\}$, where $R_0$ denotes a radius of the multiblade fan 2, $\theta$ denotes an angle measured in the direction of rotation of the multiblade fan 2 from a central point P of a tongue portion 4*k* of scroll casing 4 that defines the narrowest portion of the scroll chamber 4*a,* $\theta_0$ denotes an angle from a point Q across which a length L1 of the scroll chamber 4*a* (often called a scroll width) measured in the axial direction of the motor shaft 3*a* begins to enlarge to the central point P of the scroll-casing tongue portion 4*k,* and n denotes a so-called enlargement angle that represents the magnitude of enlargement of the scroll chamber 4*a* in the radial direction of the multiblade fan. The enlargement angle n representative of the magnitude of enlargement of scroll chamber 4*a* in the radial direction of multiblade fan 2 will be hereinafter referred to as a "radial enlargement angle n". In centrifugal multiblade blower fans used for automotive air conditioning systems, the radial enlargement angle n is usually set to range from 5 degrees ($8.72\times10^{-2}$ radians) to 8 degrees ($14.0\times10^{-2}$ radians). As fully described later in detail, in the centrifugal multiblade fan of the shown embodiment, note that the radial enlargement angle n of scroll chamber 4*a* is set at substantially 3.3 degrees. Returning to FIG. 2, the length L1 of scroll chamber 4*a* measured in the axial direction of motor shaft 3*a* is dimensioned to be longer than the length L2 of multiblade fan 2 measured in the axial direction of motor shaft 3*a*. Additionally, the scroll chamber 4*a* is gradually enlarged in the axial direction of motor shaft 3*a* as well as in the radial direction of multiblade fan 2 from the scroll-casing tongue portion 4*k* toward discharge port 4*c*.

Figure 3:
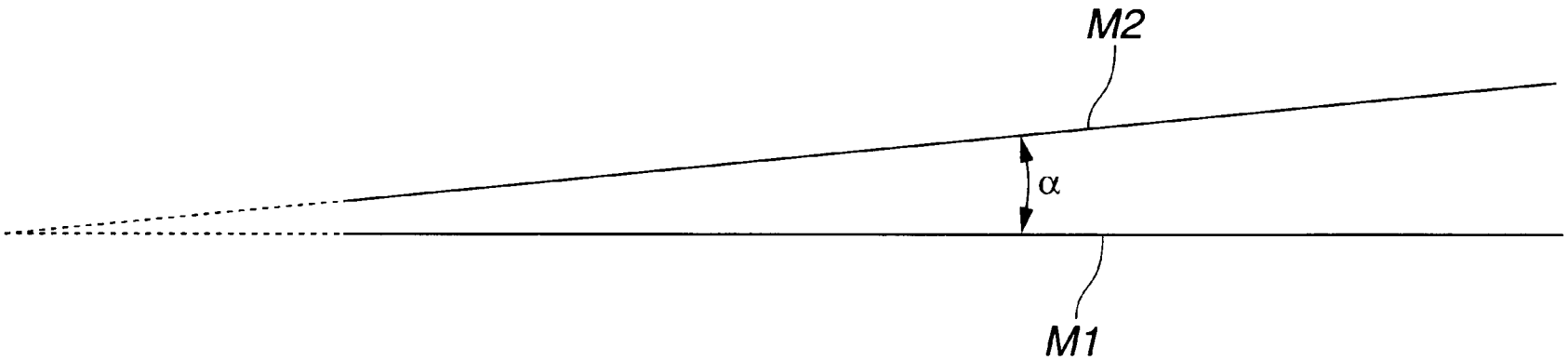
FIG. 3 is an explanatory view explaining a predetermined axial enlargement angle $\alpha$ representative of the magnitude of enlargement of the scroll chamber in the axial direction of the motor shaft.

Referring now to FIG. 3, there is shown the explanatory view used to explain how the scroll chamber is enlarged particularly in the axial direction of motor shaft 3*a*. In FIG. 3, the hypothetical straight line M1 indicates a line that the circumference of each of the substantially annular top and the substantially annular base of multiblade fan 2 is extended straight, whereas the hypothetical straight line M2 indicates a line that the logarithmic spiral outer circumference of each of the spiral top (or the upper inner peripheral wall portion) and the spiral base (or the lower inner peripheral wall portion) of scroll chamber 4*a* is extended straight in the same direction as the hypothetical line M1. The angle $\alpha$ between the two straight lines M1 and M2 means an axial enlargement angle that represents the magnitude of enlargement of scroll chamber 4*a* in the axial direction of motor shaft 3*a*. In other words, the axial enlargement angle $\alpha$ indicates how the length L1 of scroll chamber 4*a* measured in the axial direction of motor shaft 3*a* is enlarged from the scroll-casing tongue portion 4*k* toward discharge port 4*c*. In the centrifugal multiblade blower 1 of the first embodiment, the axial enlargement angle $\alpha$ is set at substantially 6 degrees.

Figure 7:
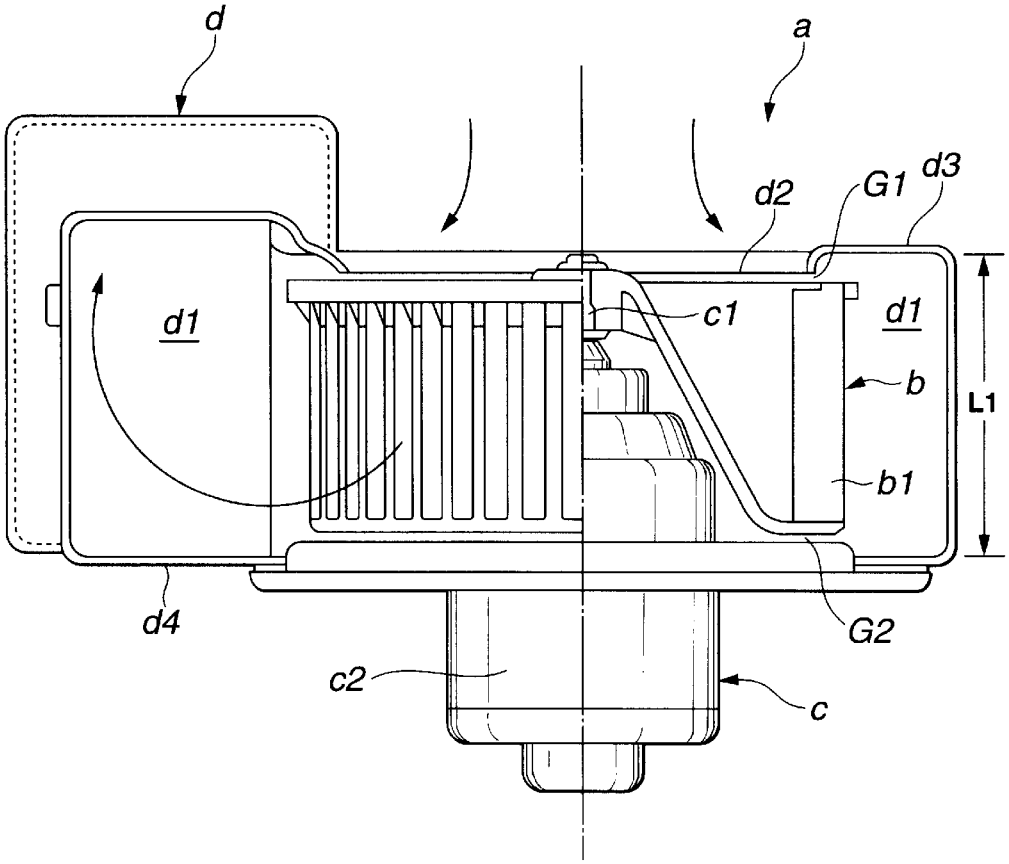
FIG.7 (PRIOR ART)
FIG. 7 is a cross-sectional view illustrating the conventional centrifugal multiblade blower.

As discussed above, in the centrifugal multiblade blower 1 of the first embodiment, as best seen in FIGS. 1 and 2, the scroll chamber 4*a* is axially uniformly enlarged on both sides at the axial enlargement angle $\alpha(\approx6°)$ from the scroll-casing tongue portion 4*k* toward discharge port 4*c*. Therefore, as compared to the scroll chamber of the conventional centrifugal multiblade blower shown in FIG. 7, the volumetric capacity of the scroll chamber 4*a* of centrifugal multiblade blower 1 of the first embodiment increases in the axial direction of motor shaft 3*a*. In the centrifugal multiblade blower of the first embodiment, on the other hand, the previously-described radial enlargement angle n is set at a relatively small angle such that the volumetric capacity of scroll chamber 4*a* is decreased by a volumetric capacity equivalent to the increase of the volumetric capacity of scroll chamber 4*a* (in the motor-shaft axial direction) arising from the axial enlargement angle $\alpha$. Actually, in the multiblade blower 1 of the first embodiment, the radial enlargement angle n is set at substantially 3.3 degrees.

In FIG. 2, reference sign G1 denotes a suction-side aperture defined between the multiblade fan 2 and the suction-side case plate 4*d*. In multiblade blower 1 of the first embodiment, a first counter-flow prevention means 10 is provided to prevent part of air flowing through scroll chamber 4*a* from flowing through the suction-side aperture G1 back to the suction port 4*b*. First counter-flow prevention means 10 is comprised of a first fan rib 11 and a first case rib 12. First fan rib 11 is formed integral with or fixedly connected onto or provided on multiblade fan 2 so that the first fan rib is protruded from the multiblade fan 2 to the suction-side aperture G1. In more detail, first fan rib 11 is formed as a circumferentially continuously extending cylindrical fan rib which has an I shape in cross section and is coaxially arranged with respect to the axis of blower fan 2 and extends completely in the circumferential direction of multiblade fan 2 around the entire circumference of the outer peripheral curved surface portion normal to and adjacent to the perimeter of the substantially annular top of multiblade fan 2 facing the screw-threaded tip end (front end) of motor shaft 3*a*. On the other hand, first case rib 12 is provided on or formed integral with suction-side case plate 4*d* so that the first case rib is protruded from the suction-side case plate 4*d* to the suction-side aperture G1. First case rib 12 is coaxially arranged with and radially spaced apart from first fan rib 11 and extends completely continuously in the circumferential direction of multiblade fan 2 so that the first fan rib 11 and the first case rib 12 are located close to each other and radially spaced from each other by a predetermined slight distance. As can be appreciated from the cross section of FIG. 2, first case rib 12 is formed at the circumferential edge portion of suction port 4*d* of suction-side case plate 4*d*. First case rib 12 has an inverted U shape in cross section that covers the cylindrical first fan rib 11. The inverted-U shaped first case rib 12 has a pair of radially opposing, inner and outer rib wall portions between which the cylindrical first fan rib 11 is located. First fan rib 11 is located in close proximity to each of the two radially opposing rib wall portions of inverted-U shaped first case rib 12. In other words, the radial distance between the first fan rib 11 and each of the two radially opposing rib wall portions of inverted-U shaped first case rib 12 is set at a predetermined small distance. The inner rib wall portion of the two radially opposing rib wall portions of inverted-U shaped first case rib 12 is formed as a bellmouth portion 4*g* of suction port 4*b*. In FIG. 2, reference sign G2 denotes a motor-side aperture defined between the multiblade fan 2 and the motor-side case plate 4*e*. In the multiblade blower 1 of the first embodiment, in addition to the previously-noted first counter-flow prevention means 10, a second counter-flow prevention means 20 is provided to prevent part of air flowing through scroll chamber 4*a* from flowing through the motor-side aperture G2 back to the upstream side of scroll chamber 4*a*. Second counter-flow prevention means 20 is comprised of a second fan rib 21 and a second case rib 22. Second fan rib 21 is formed integral with or fixedly connected onto or provided on multiblade fan 2 so that the second fan rib is protruded from the multiblade fan 2 to the motor-side aperture G2. In more detail, second fan rib 21 is formed as a circumferentially continuously extending cylindrical fan rib which is coaxially arranged with respect to the axis of the multiblade fan 2 and extends completely in the circumferential direction of multiblade fan 2 around the entire circumference of the outer peripheral portion of the substantially annular base of multiblade fan 2 facing the rear end of motor shaft 3*a*. On the other hand, second case rib 22 is provided on or formed integral with motor-side case plate 4*e* so that the second case rib is protruded from the motor-side case plate 4*e* to the motor-side aperture G2. Second case rib 22 is coaxially arranged with and radially spaced apart from second fan rib 21 and extends completely continuously in the circumferential direction of multiblade fan 2, so that the second fan rib 21 and the second case rib 22 are located close to and radially spaced from each other by a predetermined slight distance. In the multiblade blower of the first embodiment shown in FIGS. 1 and 2, second case rib 22 has a cut-out portion 23 (fully described later). As can be appreciated from the cross section of FIG. 2, second case rib 22 is formed on a substantially flat plate surface of the motor-side case plate 4*e* facing the read end surface or the base surface 2*c* of conical plate 2*b*. Motor-side case plate 4*e* is formed at its central portion with a cylindrical motor holding portion 4*h* having a cylindrical bore closed at one end. Motor holding portion 4*h* is provided to hold fan motor 3. The cylindrical opening end portion of motor holding portion 4*h* is coaxially arranged with both the second fan rib 21 and the second case rib 22, so that the outer periphery of the cylindrical opening end portion of motor holding portion 4*h* is surrounded by both the second fan rib 21 and the second case rib 22. Fan motor 3 is installed on the motor-side case plate 4*e* by fitting the motor body 3*b* into the motor holding portion 4*h*. A space S is defined between the motor-side case plate 4*e* and the conical plate 2*b* of multiblade fan 2. The motor-shaft portion (the upper portion of motor protective case 3*c*) of fan motor 3 is exposed from the cylindrical opening end of motor holding portion 4*h* into the space S. At least one motor first communication hole 3*d* is formed in a portion of motor protective case 3*c*, exposed from the opening end of motor holding portion 4*h* into the space S. In the shown embodiment, as seen in FIG. 2, a plurality of motor first communication holes 3*d* are formed in a portion of motor protective case 3*c*. Motor first communication hole 3*d* is provided to intercommunicate the space S and the interior space of motor body 3*b*. A motor second communication hole 3*e* is also provided in the motor protective case 3*c* such that the motor second communication hole 3*e* is located near the closed end of motor holding portion 4*h*. Motor second communication hole 3*e* is provided to intercommunicate the interior and exterior of motor body 3*b*. On the other hand, motor holding portion 4*h* has a motor-holding-portion communication hole 4*i* formed therein such that the motor-holding-portion communication hole 4*i* conforms to the motor second communication hole 3*e*. Motor-holding-portion communication hole 4*i* is provided to communicate the interior space of motor body 3*b* via motor second communication hole 3*e* and motor-holding-portion communication hole 4*i* with the exterior of the motor holding portion 4*h*. Motor-side case plate 4*e* is formed with a case communication hole 4*j* located near the discharge port 4*c* of scroll casing 4. Case communication hole 4*j* is provided to intercommunicate the interior and exterior of scroll chamber 4*a*. As can be seen from the cross section of FIG. 2, the motor-holding-portion communication hole 4*i* and the case communication hole 4*j* are communicated with each other via a communication member 5 attached to the motor-side case plate 4*e*.

As discussed above, scroll chamber 4*a* is gradually enlarged in cross section from the from the scroll-casing tongue portion 4*k* toward discharge port 4*c*. By virtue of the gradually enlarged cross section of the scroll chamber, part of kinetic energy given to the air drawn from the suction port 4*b* into the interior of scroll casing 4 by means of the multiblade fan 2 is converted into static pressure. Thus, an air-passage area in scroll chamber 4*a* close to the discharge port 4*c* serves as the highest pressure area (simply, high-pressure area). The previously-noted case communication hole 4*j* is provided at the high-pressure area of scroll chamber 4*a* adjacent to discharge port 4*c*. Therefore, a part of air in the high-pressure area of scroll chamber 4*a* is introduced through the case communication hole 4*j,* motor-holding-portion communication hole 4*i,* motor second communication hole 3*e* into the interior space of the motor body 3*b.* Thereafter, the air introduced into the interior of motor body flows through motor first communication holes 3*d* into the space S. That is, the case communication hole 4*j,* communication member 5, motor-holding-portion communication hole 4*i,* and motor second communication hole 3*e* cooperate with each other to provide a communication portion 6 through which the high-pressure area of scroll chamber 4*a* and the interior space of motor body 3*b* of fan motor 3 are communicated with each other. The previously-noted second case rib 22 is formed with the cut-out portion 23 which is exposed to a low-pressure area of scroll chamber 4*a* having a lower pressure than the pressure in the high-pressure area of the scroll chamber. Second-case-rib cut-out portion 23 is provided to intercommunicate the space S and the low-pressure area of scroll chamber 4*a.* Thus, a part of air flowing through the high-pressure area of scroll chamber 4*a* flows via the communication portion 6 into the interior space of motor body 3*b,* and passes through the interior of motor body 3*b,* and then flows from first communication holes 3*d* into the space S defined in conical plate 2*b.* Thereafter, the air further flows from the cut-out portion 23 of second case rib 22 back to the low-pressure area of scroll chamber 4*a.*

Figure 4:
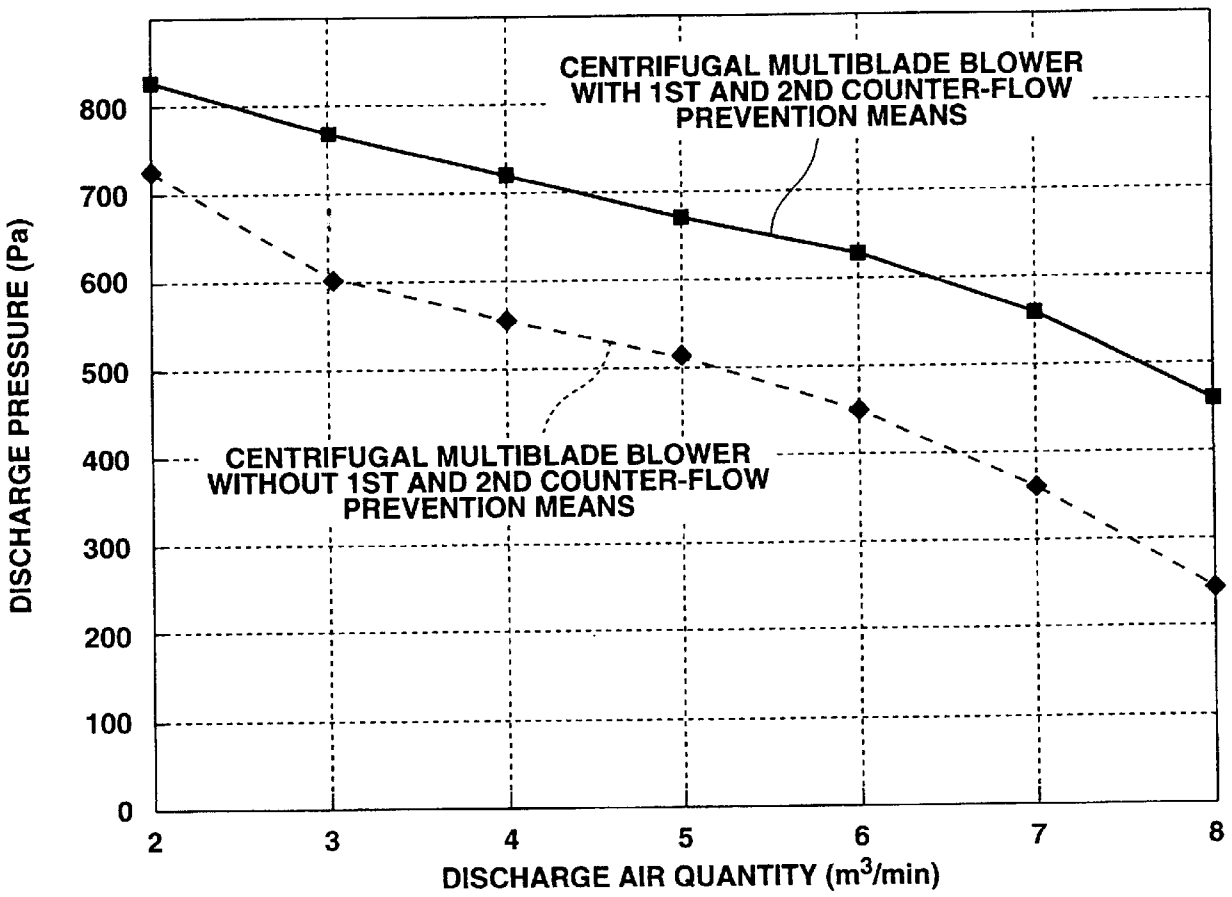
FIG. 4 is a graph showing a blower fan performance of the centrifugal multiblade blower of the first embodiment of FIG. 1.

Referring now to FIG. 4, there is shown comparison between the performance of the centrifugal multiblade blower with and without the first and second counter-flow prevention means 10 and 20. The axis of ordinate (y-coordinate) of the graph of FIG. 4 indicates a discharge pressure (unit: Pa) in a tested point of a straight air duct connected to the discharge port 4*c* of scroll casing 4. The tested point of the straight air duct is spaced apart from the discharge port 4*c* by a predetermined distance. The axis of abscissas (x-coordinate) of the graph of FIG. 4 indicates a discharge air quantity per minute (unit: $m^3$/min) of the air discharged from the discharge port 4*c*. In FIG. 4, the upper polygonal solid line indicates the performance of the centrifugal multiblade blower of the first embodiment with first and second counter-flow prevention means 10 and 20, whereas the lower polygonal broken line indicates the performance of the centrifugal multiblade blower without first and second counter-flow prevention means 10 and 20. The multiblade blower indicated by the lower polygonal broken line has almost the same structure as the multiblade blower indicated by the upper polygonal solid line, except that first and second counter-flow prevention means 10 and 20 are not provided. As can be appreciated from comparison between the upper and lower blower performance characteristic curves of FIG. 4, under the condition that the same discharge air quantity must be attained, the discharge pressure created by the multiblade blower with the first and second counter-flow prevention means is higher than that created by the multiblade blower without the first and second counter-flow prevention means. As discussed above, the radial enlargement angle n of scroll chamber 4*a* of centrifugal multiblade blower 1 of the first embodiment is set at substantially 3.3 degrees. When considering the blower-performance test result of FIG. 4, note that the upper blower performance characteristic curve obtained by the multiblade blower of the first embodiment (having radial enlargement angle n set at substantially 3.3 degrees and equipped with first and second counter-flow prevention means 10 and 20) is substantially identical to the blower performance characteristic curve obtained by the conventional multiblade blower (having radial enlargement angle n set at substantially 6.3 degrees and the same scroll-chamber volumetric capacity as the first embodiment and not equipped with first and second counter-flow prevention means 10 and 20).

As set forth above, in the centrifugal multiblade blower 1 of the first embodiment, the radial enlargement angle n of scroll chamber 4*a* is set at substantially 3.3 degrees and thus the distance between the outer peripheral wall plate 4*f* of scroll casing 4 and the multiblade fan 2 is dimensioned to be shorter than that of the conventional multiblade blower having radial enlargement angle n set at substantially 6.3 degrees. For the reasons set out above, assuming that the multiblade blower 1 of the first embodiment having radial enlargement angle n set at substantially 3.3 degrees is not equipped with first and second counter-flow prevention means 10 and 20, the counter-flow rate of air flowing from scroll chamber 4*a* via suction-side aperture G1 back to suction port 4*b,* and the counter-flow rate of air flowing from scroll chamber 4*a* via motor-side aperture G2 back to the upstream side of scroll chamber 4*a* both tend to increase rather than the conventional multiblade blower with the scroll chamber having radial enlargement angle n set at substantially 6.3 degrees and without the first and second counter-flow prevention means. In this case (with radial enlargement angle n set at substantially 3.3 degrees and without first and second counter-flow prevention means 10 and 20), as shown in the lower polygonal broken line of FIG. 4, the blower performance deteriorates. Although radial enlargement angle n of scroll chamber 4*a* is set at substantially 3.3 degrees, centrifugal multiblade blower 1 of the first embodiment is actually equipped with first and second counter-flow prevention means 10 and 20. Therefore, in centrifugal multiblade blower 1 of the first embodiment, it is possible to maintain its blower performance at the same performance as the conventional multiblade blower having radial enlargement angle n set at substantially 6.3 degrees and the same scroll-chamber volumetric capacity as the first embodiment and not equipped with first and second counter-flow prevention means 10 and 20.

As will be appreciated from the above, in centrifugal multiblade blower 1 of the first embodiment, the length L1 of scroll chamber 4*a* measured in the motor-shaft axial direction is dimensioned to be longer than the length L2 of multiblade fan 2 measured in the motor-shaft axial direction, and additionally the scroll chamber 4*a* is gradually enlarged in the motor-shaft axial direction (at the axial enlargement angle $\alpha$ such as approximately 6 degrees) from the scroll-casing tongue portion 4*k* toward discharge port 4*c*. Therefore, even when the size of the scroll casing 4 measured in the radial direction of multiblade fan 2 is reduced by decreasing the radial enlargement angle n in comparison with the conventional multiblade blower, owing to the axial enlargement angle $\alpha$ set at approximately 6 degrees a cross-sectional area of a cross section of scroll chamber 4*a* cut along a radial plane radially extending from the axis of motor shaft 3*a* can be set to be substantially identical to that of the conventional multiblade blower. Also, even when the radial enlargement angle n of scroll chamber 4*a* is set at a comparatively small value such as substantially 3.3 degrees, the counter-flow of air flowing from scroll chamber 4*a* via suction-side aperture G1 back to suction port 4*b* is suppressed or prevented by means of first counter-flow prevention means 10. Additionally, the counter-flow of air flowing from scroll chamber 4*a* via motor-side aperture G2 back to the upstream side of scroll chamber 4*a* is suppressed or prevented by means of second counter-flow prevention means 20. By the provision of first and second counter-flow prevention means 10 and 20, even in the multiblade blower with the scroll chamber having radial enlargement angle n set at substantially 3.3 degrees it is possible to maintain the blower fan total efficiency at the same level as the conventional multiblade blower with the scroll chamber having radial enlargement angle n set at substantially 6.3 degrees. By effectively reducing both (i) the counter-flow rate of air flowing from scroll chamber 4*a* via suction-side aperture G1 back to suction port 4*b,* and (ii) the counter-flow rate of air flowing from scroll chamber 4*a* via motor-side aperture G2 back to the upstream side of scroll chamber 4*a* by way of first and second counter-flow prevention means 10 and 20, it is possible to reducing undesired noises and vibrations to the same noise/vibration level as the conventional multiblade blower with the scroll chamber having a comparatively great radial enlargement angle. In this manner, in centrifugal multiblade blower 1 of the first embodiment, the scroll casing 4 can be down-sized in the radial direction of multiblade fan 2 by decreasing radial enlargement angle n. Furthermore, in multiblade blower 1 of the first embodiment, first counter-flow prevention means 10 is comprised of first fan rib 11 and first case rib 12, and additionally first case rib 12 is coaxially arranged with and radially spaced apart from first fan rib 11 and extends completely continuously in the circumferential direction of multiblade fan 2 so that first fan rib 11 and first case rib 12 are located close to each other and radially spaced from each other by a predetermined slight distance or a predetermined slight space or a predetermined slight gap. The predetermined slight gap defined between the two adjacent first ribs (11, 12) is effective to suppress or prevent air flowing through scroll chamber 4*a* from flowing through suction-side aperture G1 back to suction port 4*b*. In a similar manner, in multiblade blower 1 of the first embodiment, second counter-flow prevention means 20 is comprised of second fan rib 21 and second case rib 22, and additionally second case rib 22 is coaxially arranged with and radially spaced apart from second fan rib 21 and extends completely continuously in the circumferential direction of multiblade fan 2 so that second fan rib 21 and second case rib 22 are located close to each other and radially spaced from each other by a predetermined slight distance or a predetermined slight space or a predetermined slight gap. The predetermined slight gap defined between the two adjacent second ribs (21, 22) is effective to suppress or prevent air flowing through scroll chamber 4*a* from flowing through motor-side aperture G2 back to the upstream side of scroll chamber 4*a*. In order to effectively cool the fan motor, second case rib 22 is formed with cut-out portion 23. As discussed above, second-case-rib cut-out portion 23 is exposed to a low-pressure area of scroll chamber 4*a* having a comparatively low pressure. Thus, there is less counter-flow from second-case-rib cut-out portion 23 to the upstream side of scroll chamber 4*a,* and therefore it is possible to effectively suppress or prevent the counter-flow from motor-side aperture G2 to the upstream side of scroll chamber 4*a* by way of the two adjacent second ribs (21, 22). Also, in multiblade blower 1 of the embodiment, a part of air flowing through the high-pressure area of scroll chamber 4*a* is effectively used in order to efficiently cool the interior of motor body 3*b*. Actually, a motor cooling air passage is constructed such that a part of air flows through communication portion 6 into the interior of motor body 3*b,* and passing through the interior space of motor body 3*b,* and flowing through motor first communication holes 3*d* into the space S defined conical plate 2*b,* and then flows from second-case-rib cut-out portion 23 back to the low-pressure area of scroll chamber 4*a*. Thus, it is possible more effectively cool the interior of motor body 3*b* by way of circulating flow of a part of air flowing through the high-pressure area of scroll chamber 4*a* from the high-pressure side of scroll chamber 4*a* through communication portion 6 via the interior of motor body 3*b* to the low-pressure side of scroll chamber 4*a*. Additionally, in multiblade blower 1 of the first embodiment, first fan rib 11 of first counter-flow prevention means 10 is formed on the outer peripheral curved surface portion normal to and adjacent to the perimeter of the substantially annular top of multiblade fan 2 facing the screw-threaded tip end of motor shaft 3*a*. Thus, it is possible to minimize or reduce the flow resistance of air introduced through suction port 4*b* into scroll casing 4, while maintaining suction port 4*b* at as wide an opening area as possible. This enhances the blower fan total efficiency and reduces noises and vibrations.

Figure 5:
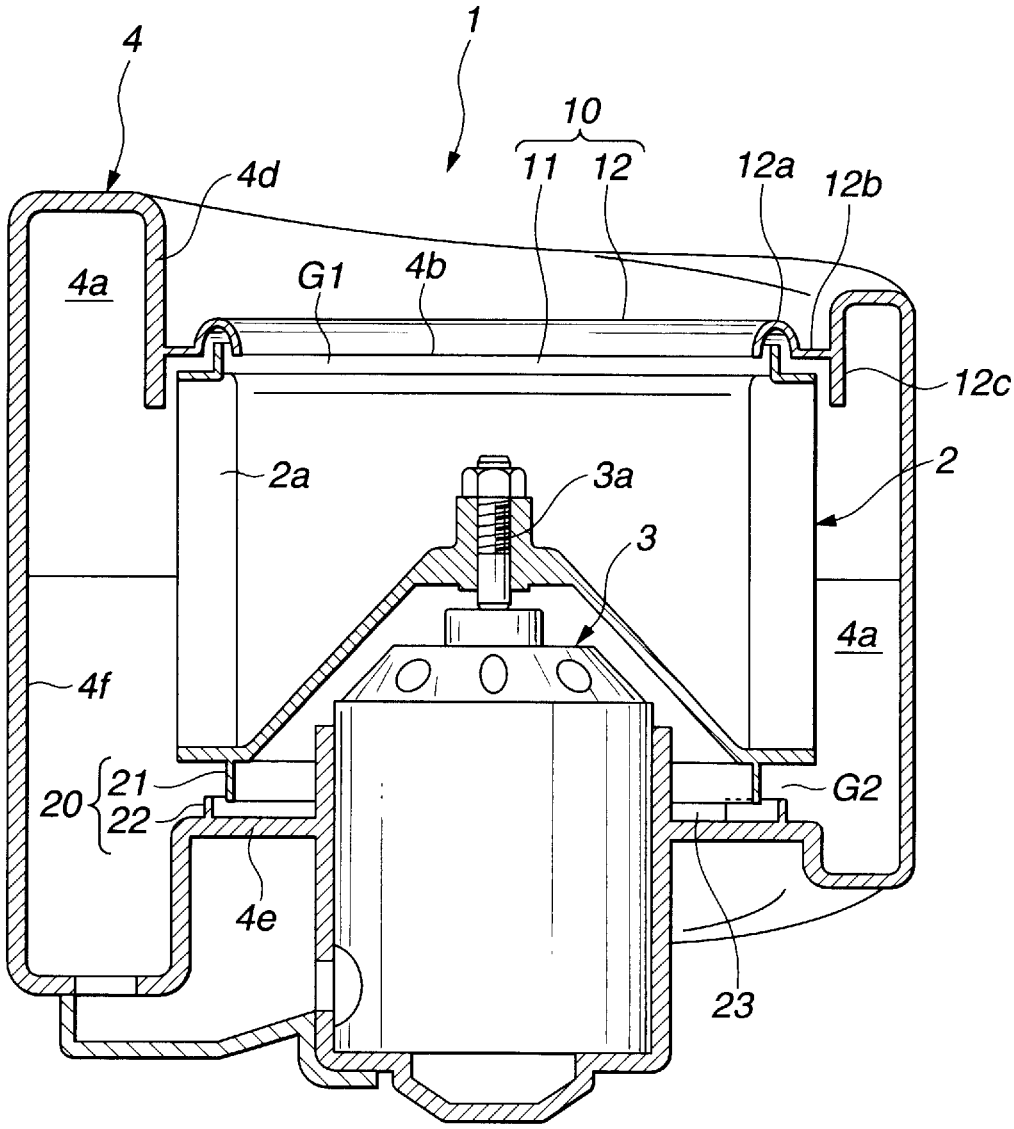
FIG. 5 is a cross-sectional view illustrating a second embodiment of the centrifugal multiblade blower of the invention.

Referring now to FIG. 5, there is shown the centrifugal multiblade blower of the second embodiment. The multiblade blower of the second embodiment of FIG. 5 is similar to the multiblade blower of the first embodiment of FIGS. 1 and 2, except that the shape and structure of first fan rib 11 and first case rib 12 both constructing first counter-flow prevention means 10 differ. Thus, the same reference signs used to designate elements in the multiblade blower of the first embodiment shown in FIGS. 1 and 2 will be applied to the corresponding reference signs used in the multiblade blower of the second embodiment shown in FIG. 5, for the purpose of comparison of the first and second embodiments. Detailed description of the same elements will be omitted because the above description thereon seems to be self-explanatory. In the multiblade blower of the second embodiment of FIG. 5, first fan rib 11 constructing part of first counter-flow prevention means 10 is formed as a rimmed annular fan rib which has a L shape in cross section and is coaxially arranged with respect to the axis of blower fan 2 and extends completely continuously in the circumferential direction of multiblade fan 2 around the entire circumference of the perimeter of the substantially annular top of multiblade fan 2 facing the screw-threaded tip end of motor shaft 3*a*. On the other hand, first case rib 12 provided on or formed integral with suction-side case plate 4*d* is comprised of first, second, and third rib portions 12*a,* 12*b,* and 12*c*. First rib portion 12*a* has an inverted-U shape in cross section that covers the axially circumferentially extending rimmed portion of first fan rib 11 with a predetermined clearance or a predetermined aperture, and coaxially located close to first fan rib 11 so that first rib portion 12*a* and first fan rib 11 are radially spaced from each other by a predetermined slight distance on both sides of the axially circumferentially extending rimmed portion of first fan rib 11. Second rib portion 12*b* is formed as a radially-extending annular flat-faced rib portion formed integral with suction-side case plate 4*d* and extending radially outwards from the outer periphery of inverted-U shaped rib portion 12*a* and located parallel to and close to the perimeter of the substantially annular top of multiblade fan 2 facing the screw-threaded tip end of motor shaft 3*a* by a predetermined slight distance. Third rib portion 12*c* is formed as a substantially cylindrical rib portion formed integral with suction-side case plate 4*d* and extending perpendicular to annular flat-faced second rib portion 12*b* and located adjacent to the circumference of the outer peripheral curved surface portion normal to and adjacent to the perimeter of the substantially annular top of multiblade fan 2 facing the screw-threaded tip end of motor shaft 3*a* by a predetermined slight distance. In the multiblade blower of the second embodiment, due to rimmed annular first fan rib 11 having a L shape in cross section and the cross section of first case rib 12 contoured with respect to the L-shaped rimmed annular first fan rib 11, first fan rib 11 and first case rib 12 are coaxially located close to each other and axially as well as radially spaced from each other by a predetermined slight distance or a predetermined slight space or a predetermined slight gap. The total length of the predetermined slight gap defined between the two adjacent first ribs (11, 12) of the multiblade blower of the second embodiment is longer than that of the first embodiment. The multiblade blower of the second embodiment is superior to that of the first embodiment in the ability to reduce the counter-flow rate of air flowing from scroll chamber 4*a* via suction-side aperture G1 back to suction port 4*b*. In other words, the blower fan total efficiency of the multiblade blower of the second embodiment is more enhanced rather than that of the first embodiment. In the multiblade blower of the second embodiment, it is possible to more effectively reduce undesired noises and vibrations during operation of the multiblade fan.

In the centrifugal multiblade blower 1 of the first embodiment, the scroll chamber 4*a* is axially uniformly enlarged on both sides (in opposite axial directions of motor shaft 3*a*) at the axial enlargement angle $\alpha(\approx 6°)$ from the scroll-casing tongue portion 4*k* toward discharge port 4*c*. In lieu thereof, the scroll chamber 4*a* is axially enlarged on one side (in one axial direction of motor shaft 3*a*) at an axial enlargement angle $\alpha$ from the scroll-casing tongue portion 4*k* toward discharge port 4*c*. In order to minimize fluctuations in the velocity of air discharged from the discharge port 4*c*, it is more preferable that the scroll chamber 4*a* is axially uniformly enlarged on both sides (in opposite axial directions of motor shaft 3*a*) at the axial enlargement angle $\alpha(\approx 6°)$ from the scroll-casing tongue portion 4*k* toward discharge port 4*c*.

The entire contents of Japanese Patent Application No. P2000-237277 (filed Aug. 4, 2000) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A centrifugal multiblade blower comprising:

a multiblade fan having a fan motor;

a scroll casing that accommodates the multiblade fan;

a first counter-flow prevention structure comprising a first annular fan rib on one of an upper side of the fan and the scroll casing, and a first annular recess formed in the other of the upper side of the fan and the scroll casing into which the first annular rib extends;

a second counter-flow prevention structure comprising a second annular fan rib provided on one of a lower side of the fan and the scroll housing, the second annular fan rib extending into a second annular recess formed in the other of the lower side of the fan and the scroll casing;

a cooling passage structure which includes a case disposed about the motor, the cooling passage having an upstream end fluidly communicated with the scroll casing downstream of the fan at a first location of high static pressure and a downstream end which includes a space enclosed by the lower side of the fan and the second annular fan rib, and which is communicated with the scroll casing at a second location of low static pressure.

2. A centrifugal multiblade blower comprising:

a multiblade fan (2) having a plurality of blades (2*a*);

a fan motor (3) having a motor shaft (3*a*) on which the multiblade fan (2) is mounted;

a scroll casing (4) that accommodates therein the multiblade fan (2) and has a discharge port (4*c*) and cooperates with an outer periphery of the multiblade fan (2) to define a spiral scroll chamber (4*a*);

the casing comprising:

(i) a suction-side case plate (4*d*) having a suction port (4*b*); and (ii) a motor-side case plate (4*e*) which is located opposite to the suction-side case plate (4*d*) in such a manner as to sandwich the multiblade fan (2) between the suction-side case plate (4*d*) and the motor-side case plate (4*e*), and on which a motor body (3*b*) of the fan motor (3) is mounted;

a first counter-flow prevention means (10) for preventing part of air flowing through the scroll chamber (4*a*) from flowing through a first aperture (G1) defined between the multiblade fan (2) and the suction-side case plate (4*d*) back to the suction port (4*b*);

a second counter-flow prevention means (20) for preventing part of air flowing through the scroll chamber (4*a*) from flowing through a second aperture (G2) defined between the multiblade fan (2) and the motor-side case plate (4*e*) back to an upstream side of the scroll chamber (4*a*);

a length (L1) of the scroll chamber (4*a*) measured in an axial direction of the motor shaft (3*a*) being dimensioned to be longer than a length (L2) of the multiblade fan (2) measured in the axial direction of the motor shaft (3*a*), and the scroll chamber (4*a*) being gradually enlarged toward the discharge port (4*c*) of the casing (4);

the second counter-flow prevention means (20) comprising:

(i) a second fan rib (21) provided on the multiblade fan (2) so that the second fan rib is protruded from the multiblade fan (2) to the second aperture (G2), and coaxially arranged with respect to the axis of the multiblade fan (2) and extending completely in the circumferential direction of the multiblade fan (2) around an entire circumference of an outer peripheral portion of a base of the multiblade fan (2) facing a rear end of the motor shaft (3*a*); and (ii) a second case rib (22) provided on the motor-side caseplate (4*e*) so that the second case rib (22) is protruded from the motor-side case plate (4*e*) to the second aperture (G2), and coaxially arranged with and radially spaced apart from the second fan rib (21), and extending completely in the circumferential direction of the multiblade fan (2) so that the second fan rib (21) and the second case rib (22) are located close to and radially spaced from each other by a predetermined distance;

a motor protective case (3*c*) that protects the motor body (3*b*);

a motor cooling passage system using a pressure differential between a pressure in a high-pressure area of the scroll chamber having a comparatively high pressure and a pressure in a low-pressure area of the scroll chamber having a lower pressure than the pressure in the high-pressure area, the motor cooling passage system comprising:

(i) a communication portion (6) that intercommunicates an interior space of the motor body (3*b*) and the high-pressure area of the scroll chamber;

(ii) a cut-out portion (23) formed in the second case rib (22) and exposed to the low-pressure area of the scroll chamber to intercommunicate the low-pressure area of the scroll chamber and a space (S) which is defined between the motor-side case plate (4*e*) and the multiblade fan (2) and into which a portion of the motor body (3*b*) is exposed; and (iii) at least one communication hole (3*d*), which is formed at a portion of the motor protective case (3*c*) exposed into the space (S) and through which the interior space of the motor body (3*b*) and the space (S) are intercommunicated.

3. The centrifugal multiblade blower as claimed in claim 2, wherein the scroll chamber (4*a*) is gradually enlarged in the axial direction of the motor shaft (3*a*) at an axial enlargement angle ($\alpha$) representative of a magnitude of enlargement of the scroll chamber (4*a*) in the axial direction of the motor shaft (3*a*) toward the discharge port (4*c*), and additionally the scroll chamber (4*a*) is gradually enlarged in a radial direction of the multiblade fan (2) at a radial enlargement angle (n) representative of a magnitude of enlargement of the scroll chamber (4*a*) in the radial direction of the multiblade fan (2) from a tongue portion (4*k*) of the scroll casing (4) toward the discharge port (4*c*), the radial enlargement angle (n) being defined by an expression $R=R_0\exp\{n(\theta+\theta_0)\}$, where R denotes a radius of the scroll casing (4), $R_0$ denotes a radius of the multiblade fan (2), $\theta$ denotes an angle measured in a direction of rotation of the multiblade fan (2) from a central point (P) of the tongue portion (4*k*) that defines a narrowest portion of the scroll chamber (4*a*), and $\theta_0$ denotes an angle from a point (Q) across which the length (L1) of the scroll chamber (4*a*) measured in the axial direction of the motor shaft (3*a*) begins to enlarge to the central point (P) of the tongue portion (4*k*).

4. The centrifugal multiblade blower as claimed in claim 3, wherein the axial enlargement angle ($\alpha$) of the scroll chamber (4*a*) is set at substantially 6 degrees.

5. The centrifugal multiblade blower as claimed in claim 4, wherein the radial enlargement angle (n) of the scroll chamber (4*a*) is set at substantially 3.3 degrees.

6. The centrifugal multiblade blower as claimed in claim 5, wherein the scroll chamber (4*a*) is gradually uniformly enlarged in opposite axial directions of the motor shaft (3*a*) at the axial enlargement angle ($\alpha$) of substantially 6 degrees from the tongue portion (4*k*) toward the discharge port (4*c*).

7. The centrifugal multiblade blower as claimed in claim 2, wherein:

the first counter-flow prevention means (10) comprises:

(i) a first fan rib (11) provided on the multiblade fan (2) so that the first fan rib (11) is protruded from the multiblade fan (2) to the first aperture (G1), and coaxially arranged with respect to an axis of the multiblade fan (2) and extending completely in a circumferential direction of the multiblade fan (2) around an entire circumference of n outer peripheral curved surface portion normal to and adjacent to a perimeter of a p of the multiblade fan (2) facing a front end of the motor shaft (3*a*); and (ii) a first case rib (12) provided on the suction-side case plate (4*d*) so that the first case rib (12) is protruded from the suction-side case plate (4*d*) to the first aperture (G1), and coaxially arranged with and radially spaced apart from the first fan rib (11), and extending completely in the circumferential direction of the multiblade fan (2) so that the first fan rib (11) and the first case rib (12) are located close to each other and radially spaced from each other by a predetermined distance.

8. The centrifugal multiblade blower as claimed in claim 7, wherein the first fan rib (11) is formed as a cylindrical fan rib having an I shape in cross section, and the first case rib (12) is formed as an inverted U shaped first case rib that covers the first fan rib (11) and has a pair of radially opposing, inner and outer rib wall portions between which the first fan rib (11) is located in close proximity to each of the radially opposing, inner and outer rib wall portions.

9. The centrifugal multiblade blower as claimed in claim 6, wherein the first fan rib (11) is formed as a rimmed annular fan rib having a L shape in cross section and coaxially arranged with respect to the axis of the multiblade fan (2) and extending completely in the circumferential direction of the multiblade fan (2) around the entire circumference of the perimeter of the top of the multiblade fan (2), and the first case rib (12) comprises:

(i) a first rib portion (12*a*) formed as an inverted U shaped case rib portion that covers the rimmed annular fan rib with a predetermined clearance, and coaxially located close to the first fan rib (11) so that the first rib portion (12*a*) and the first fan rib (11) are radially spaced from each other by a predetermined distance on both sides of the rimmed annular fan rib;

(ii) a second rib portion (12*b*) formed as a radially-extending annular flat-faced rib portion formed integral with the suction-side case plate (4*d*) and extending radially outwards from an outer periphery of the inverted U shaped case rib portion and located parallel to and close to the perimeter of the top of the multiblade fan (2) by a predetermined distance;

(iii) a third rib portion (12*c*) formed as a substantially cylindrical rib portion formed integral with the suction-side case plate (4*d*) and extending perpendicular to the radially-extending annular flat-faced rib portion and located adjacent to the circumference of the outer peripheral curved surface portion normal to and adjacent to the perimeter of the top of the multiblade fan (2) by a predetermined distance.

* * * * *